United States Patent [19]

Aguirre

[11] Patent Number: 4,733,837

[45] Date of Patent: Mar. 29, 1988

[54] NURSING BOTTLE SUPPORT

[76] Inventor: Everardo M. Aguirre, La Perpetua 1688, J. del Country S.H., 44210 - Guadalajara, Jal., Mexico

[21] Appl. No.: 877,429

[22] Filed: Jun. 23, 1986

[51] Int. Cl.[4] ..... A47B 15/00

[52] U.S. Cl. ..... 248/106

[58] Field of Search ..... 248/58, 59, 102, 105, 248/106, 107, 121, 122, 125, 153, 163.1, 163.2, 339, 164, 431

[56] References Cited

U.S. PATENT DOCUMENTS

| | | | |
|---|---|---|---|
| 622,414 | 4/1899 | Bradbury | 248/107 |
| 743,914 | 10/1903 | McMurran | 248/106 |
| 1,670,029 | 5/1928 | Fetter | 248/164 |
| 2,673,705 | 3/1954 | Buckley | 248/102 |
| 2,681,782 | 6/1954 | Morishita | 248/106 |
| 2,891,752 | 6/1959 | Genter | 245/339 |
| 2,939,360 | 6/1960 | Carten | 248/431 |
| 3,592,475 | 7/1971 | Terry | 248/431 |
| 4,513,935 | 4/1985 | Aguirre | 248/102 |

FOREIGN PATENT DOCUMENTS

| | | | |
|---|---|---|---|
| 627265 | 9/1927 | France | 248/102 |
| 194233 | 3/1923 | United Kingdom | 248/102 |

OTHER PUBLICATIONS

Modern Hanger Corporation Catalogue, p. 67, 1953.

*Primary Examiner*—J. Franklin Foss
*Assistant Examiner*—Robert A. Olson
*Attorney, Agent, or Firm*—Michael J. Striker

[57] ABSTRACT

A nursing bottle support, having an articulated tripod from which hang three screws and a wire framework wherein the nursing bottle is positioned. The framework has three hooks, one for grasping the neck of the nursing bottle and the other two for supporting the body. The object is to sustain the nursing bottle in position to enable the baby to ingest the liquid food contained therein.

16 Claims, 2 Drawing Figures

NURSING BOTTLE SUPPORT

BACKGROUND OF THE INVENTION

The present invention concerns improvements to a nursing bottle support.

With this bottle support it is easier to feed the baby than with the nursing bottle support described in the U.S. Pat. No. 4,513,935 which was granted to this inventor.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE INVENTION

Figure 1:
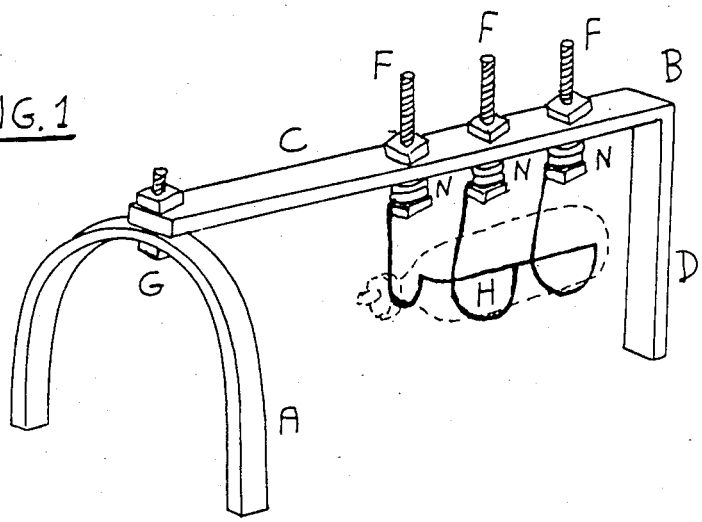
FIG. 1 is a conventional perspective view of the nursing bottle support embodying the features of this invention.
Figure 2:
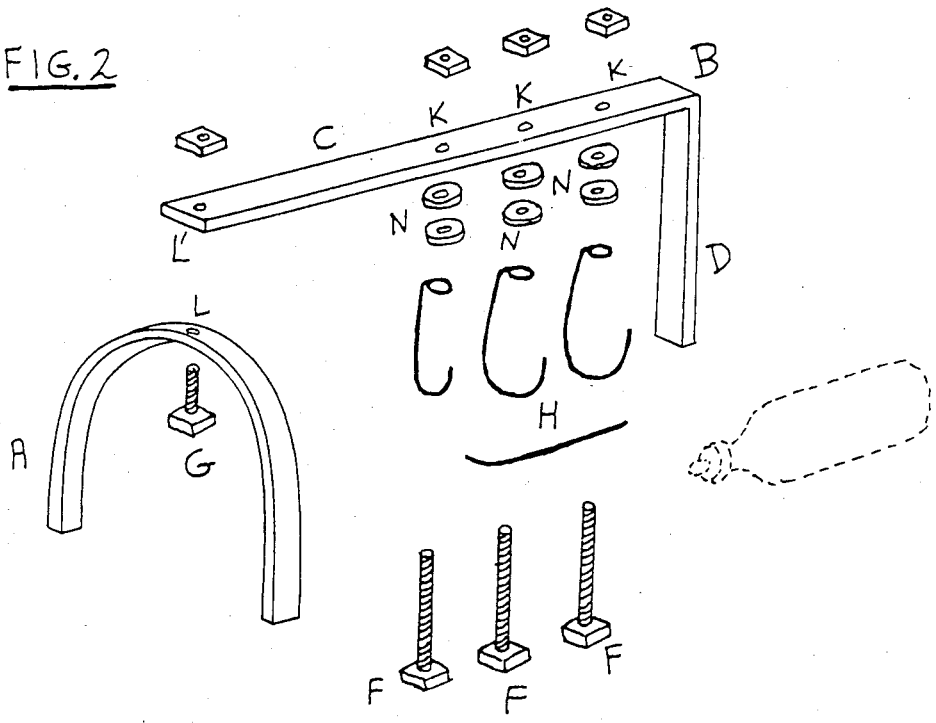
FIG. 2 is an exploded perspective view of the separate elements of the nursing bottle support shown in FIG. 1.

A nursing bottle is illustrated schematically in the drawings by broken lines.

The nursing bottle support is characterized by an articulated tripod fastened together by a screw G with nut. Three screws F with respective nuts hang from the support to support a wire framework H, into which the nursing bottle is positioned.

The articulated tripod is made of metal and is constructed with two rods. One of these rods is a semicircular-shaped or arc-shaped rod A and the other is an angular-shaped rod B.

The semi-circular rod A is half circle-shaped, the concavity being directed downward, and its ends constituting two of the three tripod legs. This semi-circular rod A has a 3/32 inch diameter vertical hole L, located at its central portion, which is provided for the passage of the screw G, which articulates the two rods A and B, one to the other.

The angular rod B is right angle shaped, with one of its sides C being horizontally disposed and the other side D being vertically disposed. The horizontal side C is about 16 inches long and has four 3/32 inch diameter vertical holes L', K, K, and K. One of these holes L' is at its free end (the opposite end from the angle vertex) to provide for the passage of the screw G, which articulates the two rods A and B, one to the other. The other three holes K, K, and K are situated along this horizontal side C at 2½, 5, and 7½ inches from the angle vertex, and these three holes provide for the passage of the three screws F, F, and F supporting the wire framework. The angular rod's vertical side D is 8 inches long and is directed downward, constituting the third tripod leg.

The screw G, which articulates the two rods A and B, enables the tripod to be positioned at the most comfortable position for feeding the baby. Rod A is adjustable relative to Rod B in such a way that it is possible to rest the tripod legs at the most convenient sites, in order to avoid the disagreeable sensation of contacting the baby skin with the rods. The baby is not disturbed.

The nursing bottle is positioned in the wire framework H. The wire is 16 gauge and is formed of at least two, preferably three J-shaped hooks. These hooks are vertical and parallel. At the top of their large stems, each hook has a small horizontal ring to provide for the passage of each one of the three screws F, F, and F supporting the framework. At the end of their small stems, each hook is secured, as by welding, equadistant to a piece of wire 16 gauge, 5 inches long, curved enough so as to coincide with the three hooks. The two hooks nearer to the angle vertex are large enough to permit the body of the nursing bottle to be inserted or received therein, and the other hook is small enough to permit the narrow part of the nursing bottle, that is the neck, to be inserted therein but not the wide part of the nursing bottle nor its cap. The three hooks are aligned in such a way that the nursing bottle can be introduced in them simultaneously, grasped by the smaller hook.

Three screws F, F, and F, with respective nuts, are provided for hanging the wire framework H from the tripod. Each screw is 2½ inches long and 3/32 inch thick. They pass through the three rings of the wire framework H and through the three holes K, K, and K situated nearest the angle vertex of the angular rod B.

One screw G with nut is provided for articulating the two rods A and B of the tripod. This screw is ¾ inch long and 3/32 inch thick, and it passes through the hole L of the semicircular rod A and through the hole L situated at the free end of the angular rod's horizontal side C.

The adequate height of the nursing bottle is obtained by inserting one or more washers N on each of the three screws that support the framework. The washers must be situated between the tripod and the wire framework.

In order to obtain stability of this nursing bottle support, the nuts of the four screws must be tightened before feeding the baby.

It will be understood that the shapes and dimensions are given by way of examples and that changes can be made, principally concerning the shape, dimensions and construction material, in accordance with the practical necessities, without departing from the spirit of the invention.

It will be understood that each of the elements described above, or two or more together, may also find a useful application in other types of nursing bottle supports differing from the types described above.

While the invention has been illustrated and described as embodied in a nursing bottle support, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A nursing bottle support, comprising:

an articulated tripod having three legs;

first screw means for adjusting said one leg relative to said other two legs;

a framework hanging under said tripod and arranged for supporting a nursing bottle for feeding a baby, one of said legs of said tripod being adjustable relative to the other two legs in a horizontal direction by turning about a substantially vertical axis so that said legs of said tripod are adjustably movable away from the skin of the baby to be fed with the nursing bottle and so that the framework is still able to support the nursing bottle for feeding the baby without moving downwardly towards the baby; and second screws means for adjusting a distance between said framework and said tripod, said framework including at least two J-shaped vertically parallel hooks, each hook having a hooked end and a top stem end with a ring-shaped portion being disposed horizontally from said top stem end, said ring-shaped portion being sized to cooperate with said second screw means for supporting said framework, one of said hooks being arranged for grasping a neck of the nursing bottle and another of said hooks being arranged for receiving a body of the nursing bottle.

2. A nursing bottle support as defined in claim 1, wherein said framework is formed as a wire framework.

3. A nursing bottle support as defined in claim 1, wherein said second screw means includes a plurality of screw fasteners.

4. A nursing bottle support as defiend in claim 3, wherein each screw fastener includes a screw, a nut, and at least one washer situated between said tripod and said framework.

5. A nursing bottle support as defined in claim 3, wherein said plurality of said screw fasteners includes at least three fasteners.

6. A nursing bottle support as defined in claim 1, wherein said tripod includes two parts, one part forming two of said three legs of said tripod and the other part forming said one leg and having a horizontal portion.

7. A nursing bottle support as defined in claim 6, wherein said first screw means includes a first screw, said second screw means including at least two second screws, said horizontal portion having at least three holes, said first screw of said first screw means engaging one of said holes, and each of said second screws of said second screw means engaging a respective one of the rest of said holes.

8. A nursing bottle support as defined in claim 6, wherein said one part is arc-shaped and said other part is angular-shaped.

9. A nursing bottle support as defined in claim 8, wherein said arc-shaped part has two ends forming said two legs of said tripod and said angular-shaped part has a vertical portion forming said one leg of said tripod.

10. A nursing bottle support as defined in claim 9, wherein said first screw means has a first screw, said arc-shaped part having a central area with a central vertical hole, said horizontal portion of said angular-shaped part containing a first hole, said arc-shaped part and said angular-shaped part arranged for articulation together by said first screw which is insertable into said central vertical hole and into said first hole.

11. A nursing bottle support as defined in claim 8, wherein said arc-shaped part has a concavity which is directed downward.

12. A nursing bottle support as defined in claim 8, wherein said angular-shaped part has a right angle vertex.

13. A nursing bottle support as defined in claim 1, wherein said tripod has an angular-shaped member including a horizontal portion and a vertical portion constituting a vertical leg of said tripod, said hooks being spaced horizontally along said horizontal portion, said one hook arranged for grasping a neck of a nursing bottle being spaced furthest away from said vertical portion.

14. A nursing bottle support; comprising:

an articulated tripod having three legs of which one leg is adjustable relative to the other two legs;

first screw means for adjusting said one leg relative to said other two legs;

a framework hanging under said tripod and arranged for supporting a nursing bottle for feeding a baby, said framework including at least two J-shaped vertically parallel hooks, each hook having a hooked end and a top stem end with a ring-shaped portion being disposed horizontally from said top stem end, said ring-shaped portion being sized to cooperate with said second screw means for supporting said framework, said framework also including a wire secured to each of said hooked ends to align said hooks with each other so that a nursing bottle is simultaneously introducible onto said hooks of said framework; and second screw means for adjusting said framework relative to said tripod.

15. A nursing bottle support as defined in claim 14, wherein said hooks are secured to said wire equidistantly from each other.

16. A nursing bottle support as defined in claim 14, wherein said wire is arranged to coincide with each hooked end of said hooks.

* * * * *